United States Patent [19]

Ozaki

[11] 4,287,843

[45] Sep. 8, 1981

[54] ELECTRIC SEWING MACHINE WITH A SPEED CONTROL SYSTEM

[75] Inventor: Yoshiaki Ozaki, Hachioji, Japan

[73] Assignee: Janome Sewing Machine Co., Ltd., Tokyo, Japan

[21] Appl. No.: 114,245

[22] Filed: Jan. 22, 1980

[30] Foreign Application Priority Data

Feb. 9, 1979 [JP] Japan ..... 54-14882[U]
Feb. 15, 1979 [JP] Japan ..... 54-17141[U]

[51] Int. Cl.[3] ..... D05B 69/18
[52] U.S. Cl. ..... 112/277
[58] Field of Search ..... 112/277, 275, 121.11, 112/220

[56] References Cited

U.S. PATENT DOCUMENTS 4,014,277 3/1977 Morinaga et al. ..... 112/277
4,150,634 4/1979 Brown et al. ..... 112/275
4,217,841 8/1980 Daido et al. ..... 112/277

*Primary Examiner*—Peter P. Nerbun
*Attorney, Agent, or Firm*—Michael J. Striker

[57] ABSTRACT

A sewing machine composed of a drive motor, an upper shaft with detector, a motor speed control and a motor starting and stopping control. The motor speed control has a bistable device to start and stop the machine in response to signals from a switch and an extreme lower speed control to drive the motor at an extreme low speed in response to a signal from a switch. Motor speed control also has counters which when set and actuated by a switch execute a predetermined finite number of stitches. Motor control device also has circuits allowing the motor to operate in response to a variable speed control switch.

3 Claims, 5 Drawing Figures

ELECTRIC SEWING MACHINE WITH A SPEED CONTROL SYSTEM

BACKGROUND OF THE INVENTION

The invention relates to an electric sewing machine, and more particularly relates to a speed control system for such a sewing machine, in which a single operating part is operated in one direction to start and stop the sewing machine. The operating part is pushed in one direction in one way to make effective an ordinary speed selecting circuit, and is pushed in the same direction in another way to make effective an extreme lower speed control circuit. The single operating part is also touched by the operator during a stitching operation to change over from the ordinary speed selecting circuit to the extreme speed control circuit.

Many devices have been provided for such a speed control of sewing machine. Such conventional speed control devices, however, have been complex in structure and rather difficult in operation.

The present invention has been provided to eliminate the defects and disadvantages of the prior art.

It is a primary object of the invention to provide a sewing machine with a speed control system which is simple in structure and easy in operation.

It is another object of the invention to heighten the operational safety of a sewing machine.

SUMMARY OF THE INVENTION

In keeping with these objects the invention consists of a sewing machine equipped with a machine drive motor, an upper shaft having a detector for counting the number of revolutions the shaft executes, and a motor speed control system including a variable motor speed control circuit. The variable motor speed control circuit establishes the speed at which the motor will operate when the control circuit is operative to permit the variable speed control to determine the motor speed.

The motor control system is composed of an electrically conductive operating means which senses the touch of the operator; a switch means operated by manipulation of the electrically conductive means and which produces a signal; a bistable functioning means to start the machine drive motor when it is stopped in response to the signal from the switch means. This bistable functioning means may be a T-type flip-flop circuit. The motor control system also responds to stop the motor when the bistable functioning means receives a signal from the switch means while the motor is rotating.

Another feature of the invention is an extreme lower speed control which may take the form of an AND circuit. This circuit is operative to drive the machine motor at an extreme lower speed when the conductive operating means is touched by the operator while the motor is running.

An additional aspect of the invention is formed by arranging a time delay means between bistable functioning means and the extreme lower speed control. This circuit maintains the motor speed at the same level the speed had before the electrically conductive operating means was touched unless the operator maintains contact with the conductive operating means for a specified time interval in which case the extreme slow speed will result.

Yet another feature of the invention resides in the use of two counter means. The first means is set by the repeated touching of the electrically conductive operating means. The number of touches sets the counter for the purpose of executing said number of stitches. The second counter is connected to the detector on the upper shaft and thus counts the number of stitches that are executed after the counter system is engaged. This aspect of the invention also utilizes a comparator means to compare the two counters and to stop the motor when the two counters have the same values. Other aspects of the invention provide for no signals from the comparator means when the first counter is set at zero and for the resetting of the counters at zero upon completion of the operation.

The other features and advantages of the invention will be apparent from the following description of preferred embodiments of the invention in reference to the attached drawings.

DESCRIPTION OF THE PREFERRED EMBODIMENTS

Figure 1:
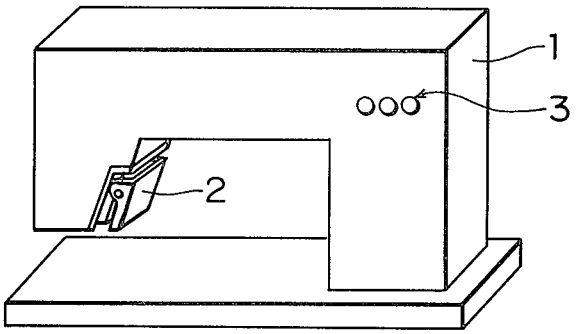
FIG. 1 is a perspective view of a sewing machine provided with the invention.
Figure 2:
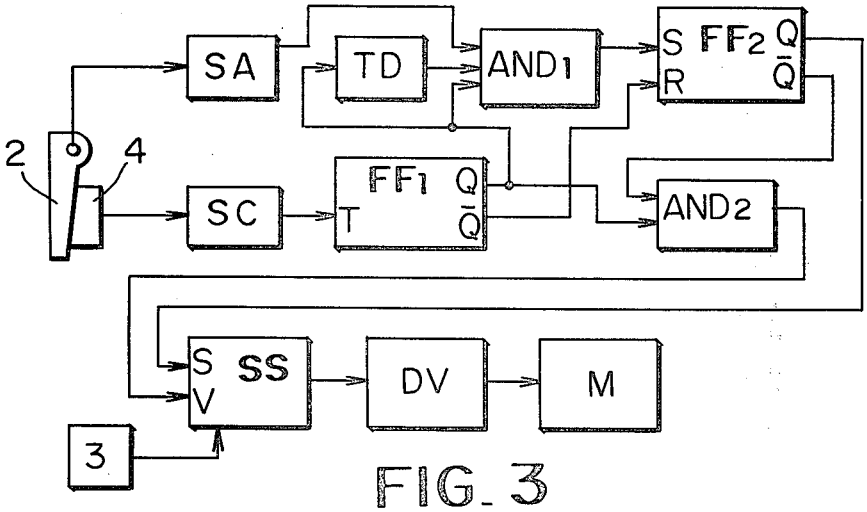
FIG. 2 is a control block circuit of the invention.

In reference to FIGS. 1 and 2, a sewing machine 1 is provided with an operating element 2 as shown, which is electrically conductive, but is electrically isolated from the sewing machine 1. The operating element 2 is connected to a contact switch circuit SA, which senses the touch of the operating element 2 by the operator's finger and operates to make effective an extreme lower speed control circuit. The operating element 2 is also pushed by the operator to operate a switch 4, which makes effective a normal speed control circuit, and makes effective a control to stop the sewing machine if it is running. The sewing machine 1 is also provided with speed changeover switches 3 each operated to change the machine speed to low, medium and high speeds respectively. The output of the switch 4 is connected to an input circuit SC which has an electric wave rectifying function and a chattering prevention function. The output of the input circuit SC is connected to the trigger terminal T of a T-type flip-flop circuit $FF_1$. The flip-flop circuit $FF_1$ is employed to start and stop the sewing machine, and is reset by the rising signal when the control power source is applied. The flip-flop circuit $FF_1$ has a true side output Q connected to a first input of an AND circuit $AND_1$ and also connected to a second input of the AND circuit $AND_1$ via a delay circuit TD.

The AND circuit $AND_1$ is a principal part of the extreme lower speed control circuit, and has a third input connected to the output of the contact switch circuit SA. The AND circuit $AND_1$ has an output connected to a set terminal S of a flip-flop circuit $FF_2$. The flip-flop circuit $FF_2$ has a set terminal R connected to the complement side output $\overline{Q}$ of the flip-flop $FF_1$, and has a true side output Q connected to an extreme lower speed setting input S of a speed setting circuit SS. The speed setting circuit SS, when the input S is high level, operates the machine motor M constantly at an extreme lower speed via a drive circuit DV. The true side output $\overline{Q}$ of the flip-flop $FF_1$ is connected to a first input of an AND circuit $AND_2$. The AND circuit $AND_2$ has another input connected to the complement side output Q of the flip-flop circuit $FF_2$, and has an output connected to a variable speed setting input V of the speed setting circuit SS, which, when the input V is high level, is operated by a signal from the manually operated changeover switches 3 to drive the machine motor M via the drive circuit DV at a low, medium or high speed. When the inputs S and V are low level, the speed setting circuit SS is operated to stop the machine motor M.

With such a structure of system, if the control power source is applied, the flip-flop $FF_1$ is reset, and accordingly the flip-flop $FF_2$, which receives the complement side output $\overline{Q}$ of the flip-flop $FF_1$, is reset, and accordingly the inputs S and V of the speed setting circuit SS are low level. Therefore, the machine motor M remains standstill. Then if the operator touches the operating element 2, the contact switch SA is operated to make one input of the AND circuit $AND_1$ high level. However, since the flip-flop $FF_1$ is reset, the AND circuits $AND_1$ and $AND_2$ are low level, and accordingly the inputs S and V of the speed setting circuit SS are low level. Therefore the machine motor M is still standstill. If the operating element is pushed, the switch 4 is closed and the input circuit SC is operated to set the flip-flop $FF_1$. If the operator takes the hand off from the operating element 2 before the delay circuit TD is operated, the AND circuit $AND_1$ remains to be low level and the flip-flop circuit $FF_2$ remains to be low level. Therefore, the AND circuit $AND_2$ becomes high level to operate the machine motor M at a speed determined by one of the speed changeover switches 3. On the other hand, if the operating element 2 is kept as it is pushed for a predetermined time until the delay circuit TD becomes high level, the flip-flop $FF_2$ is set, and the AND circuit $AND_2$ becomes low level. As a result, the machine motor M is driven at an extreme lower speed. This is the same as in the case the speed changeover switches are not operated. Then if the operator takes the hand off from the operating element 2, the flip-flop circuit $FF_2$ is not reset because the flip-flop circuit $FF_1$ has been set, and the extreme lower speed rotation of the machine motor M is maintained. If the operator touches the operating element 2 while the sewing machine is running at a speed determined by one of the speed changeover switches 3, the flip-flop circuit $FF_2$ is switched into a reset condition and the machine motor M is rotated at the extreme lower speed. If the operating element 2 is pushed while the sewing machine is running, the switch 4 is closed to reset the flip-flop circuits $FF_1$ and $FF_2$, and the machine motor M is stopped.

Figure 3:
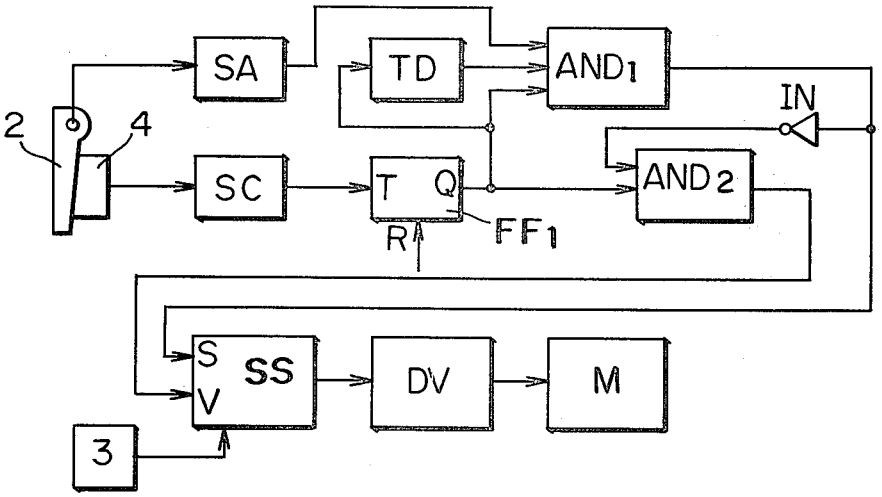
FIG. 3 is another embodiment of the control block circuit.

FIG. 3 shows a second embodiment of control block circuit, in which the flip-flop circuit $FF_2$ of FIG. 2 is not used. Instead, the output of the AND circuit $AND_1$ is connected to the extreme lower speed setting input terminal S of the speed setting circuit SS, and is also connected, through an inverter IN, to the input of the AND circuit $AND_2$. In this embodiment, so long as the operator touches the operating element 2 while the flip-flop circuit $FF_1$ is in a set condition, namely while the sewing machine is running, the AND circuit $AND_1$ becomes high level to drive the machine motor M at the extreme lower speed. If the operator takes the hand off from the operating element 2, the AND circuit $AND_2$ becomes high level to return the machine motor M to a set speed determined by one of the changover switches 3.

Figure 4:
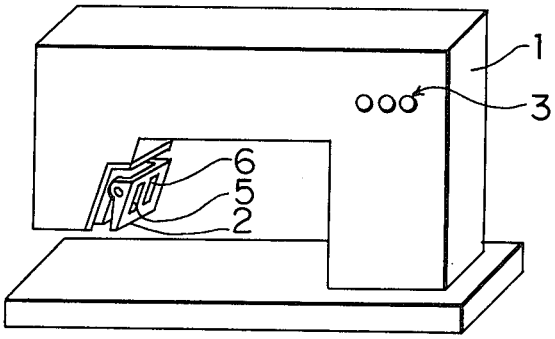
FIG. 4 is another perspective view of a sewing machine provided with a different embodiment of the invention.
Figure 5:
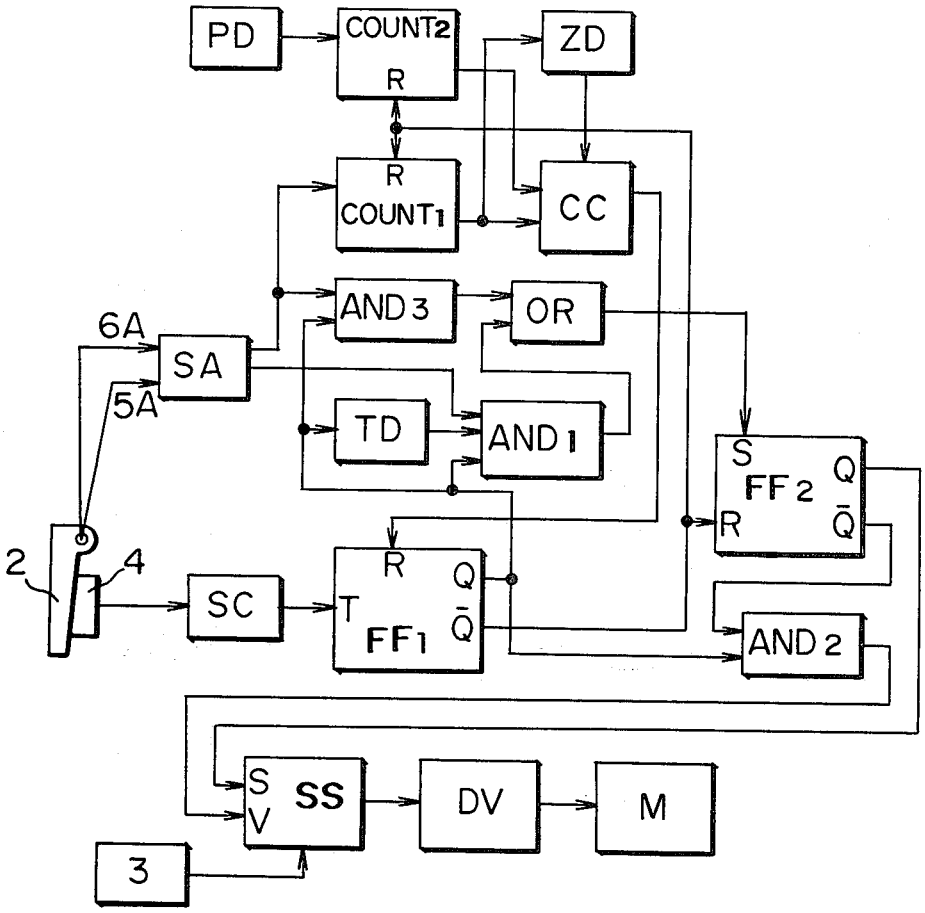
FIG. 5 is another embodiment of the control block circuit as shown in FIG. 4.

FIGS. 4 and 5 shows a third embodiment of the invention. Explanation will be made regarding only the modified parts of the first embodiment of the invention as shown in FIGS. 1 and 2.

In reference to FIG. 4, the operating element 2 is further provided with two operating parts 5 and 6 spaced froms each other. The operating element 2 may not be electrically conductive. The operating parts 5 and 6 are electrically conductive and are electrically isolated from the sewing machine 1 and from each other. The operating part 5 is to designate an extreme lower speed rotation of the sewing machine, and the operating part 6 is to designate a desired number of rotations of the sewing machine. As shown in FIG. 6, the two operating parts 5 and 6 are each connected to the contact switch circuit SA. This embodiment is different from the first embodiment of FIGS. 1 and 2 in the point that the embodiment is provided with an additional function to produce a desired number of stitches by operating the operating part 6 so many times.

According to this embodiment, if the operator touches the operating part 6, the contact switch circuit SA receives a touch input 6A. The contact switch citcuit SA has an output connected to the input side of an AND circuit $AND_3$ and to the input of a counter $COUNT_1$. A counter $COUNT_2$ receives a signal from an upper shaft position detector PD per rotation of the upper drive shaft of the sewing machine to count up the rotations of the upper shaft. The counters $COUNT_1$ and $COUNT_2$ have the respective reset input terminals R each connected to the complement side output $\overline{Q}$ of the flip-flop $FF_1$, and are each reset to 0 by a rising signal from the flip-flop when the complement side output $\overline{Q}$ becomes high level. These counters $COUNT_1$ and $COUNT_2$ have the outputs each connected to the input side of a comparator circuit CC, which is operated when the counted values of the both counters come to the same, thereby to make the reset input R of the flip-flop $FF_1$ high level to reset the flip-flop circuit. A zero-value detector ZD maintains the comparator circuit CC inoperative when the counting value of the counter $COUNT_1$ is zero, irrespectively of the counting value of the counter $COUNT_2$. The AND circuit $AND_3$ has another input terminal connected to the true side output Q of the flip-flop circuit $FF_1$, and has an output connected to one input terminal of an OR circuit OR. The OR circuit has another input terminal connected to the output of the AND circuit $AND_1$, and has an output connected to the set terminal S of the flip-flop circuit $FF_2$.

With such a structure of the embodiment in FIGS. 4 and 5, if the control power source is applied, the flip-flop circuit $FF_1$ is reset, and accordingly the flip-flop circuit $FF_2$, which receives the complement side output $\overline{Q}$ of the flip-flop circuit $FF_1$, is reset, and accordingly the inputs S and V of the speed setting circuit SS are low level. Then if the operator touches the operating part 3, the contact switch SA is operated to make one input of the AND circuit $AND_1$ high level. However, since the flip-flop $FF_1$ is reset, the AND circuits $AND_1$ and $AND_2$ are low level, and accordingly the inputs S and V of the speed setting circuit SS are low level. Therefore the machine motor M is still standstill. If the operating element 2 is pushed, the switch 4 is closed and the input circuit SC is operated to set the flip-flop $FF_1$. If the operator takes the hand off from the operating element 2 before the delay circuit TD is operated, the AND circuit $AND_1$ remains to be low level and the flip-flop circuit $FF_2$ remains to be low level. Therefore, the AND circuit $AND_2$ becomes high level to operate the machine motor M at a speed determined by one of the speed changeover switches 3. On the other hand, if the operating element 2 is kept as it is pushed for a predetermined time until the delay circuit TD becomes high level, the flip-flop $FF_2$ is set, and the AND circuit $AND_1$ becomes low level. As a result, the machine motor M is driven at an extreme lower speed. This is the same as in the case the speed changeover switches are not operated. Then if the operator takes the hand off from the operating element 2, the flip-flop circuit $FF_2$ is not reset because the flip-flop circuit $FF_1$ has been set, and the extreme lower speed rotation of the machine motor M is maintained. If the operator touches the operating part 5 while the sewing machine is running at a speed determined by one of the speed changeover switches 3, the flip-flop circuit $FF_2$ is switched into a reset condition and the machine motor M is rotated at the extreme lower speed. If the operating element 2 is pushed while the sewing machine is running, the switch 4 is closed to reset the flip-flop circuits $FF_1$ and $FF_2$, and the machine motor M is stopped.

Further in a sewing operation, it may often happen that same more stitches are carefully sewn at the end part of a stitching cycle after the sewing machine is once stopped in dependence upon the stitching type or kind. In such a case, if the stitch number designating part 6 is touched by the operator so many times as the operator requires the stitches, the number of touches is counted up by the counter $COUNT_1$. In this instance, one input terminal of the AND circuit $AND_3$ receives and input, but it gives no output because the flip-flop circuit $FF_1$ is reset, and the machine motor M remains standstill. If the operating part 6, and accordingly the operating element 2 is pushed at the last time of touching, the switch 4 is closed to set the flip-flop $FF_1$. At the same time, the output of the AND circuit $AND_3$ becomes high level and the flip-flop circuit $FF_2$ is set through the OR circuit OR, and then the machine motor M is driven at an extreme lower speed. The rotations of the machine motor are each counted up by the counter $COUNT_2$. If the counting value of the counter $COUNT_2$ comes to that of the counter $COUNT_1$, the comparator circuit CC gives an output to reset the flip-flop circuit $FF_1$, and the machine motor M is stopped. At the same time, the counters $COUNT_1$ and $COUNT_2$ are reset by the rising signal of the complement side output $\overline{Q}$ of the flip-flop circuit $FF_1$.

I claim:

1. A sewing machine with a machine drive motor having an upper drive shaft and a motor speed control system including a variable motor speed control circuit, said motor control system comprising electrically conductive operating means sensing a touch by an operator; a switch means operated by manipulation of the electrically conductive operating means to produce a signal; motor starting and stopping means including bistable functioning means to start the machine drive motor at a predetermined speed when the bistable functioning means receives the signal from the switch means while the machine drive motor is stopped, said motor starting and stopping means operating to stop the machine drive motor when the bistable functioning means receives the signal from the switch means while the machine drive motor is rotating; and extreme lower speed control means operated to drive the machine drive motor at an extreme lower speed when the operating means is touched by the operator while the machine drive motor is driven by the motor starting and stopping means.

2. A sewing machine as defined in claim 1, wherein said motor speed control system further comprises time delay means arranged between the motor starting and stopping means and the extreme lower speed control means, said time delay means being operated by the touch of the operator to the electrically conductive operating means to make effective the extreme lower speed control means.

3. A sewing machine as defined in claim 1, wherein said motor speed control system further comprises first counter means for counting up the number of touches by the operator to the electrically conductive operating means; detector means for detecting rotation of said upper drive shaft and for giving a signal per rotation of said upper drive shaft of the sewing machine; second counter means counting up the signal from the detector means; and comparator means comparing the counted values of the first and second counter means, said comparator means giving an output to the motor starting and stopping means when the counted value of the second counter means comes to be the same with the counted value of the first counter means, thereby to stop the machine drive motor.

* * * * *